United States Patent [19]

Usami

[11] Patent Number: 5,007,323

[45] Date of Patent: Apr. 16, 1991

[54] POLYPHONIC ELECTRONIC MUSICAL INSTRUMENT

[75] Inventor: Ryuji Usami, Tokyo, Japan

[73] Assignee: Casio Computer Co., Ltd., Tokyo, Japan

[21] Appl. No.: 226,936

[22] Filed: Aug. 1, 1988

[30] Foreign Application Priority Data

Aug. 7, 1987 [JP] Japan ..... 62-196455
Aug. 17, 1987 [JP] Japan ..... 62-203200

[51] Int. Cl.[5] ..... G10H 7/00

[52] U.S. Cl. ..... 84/607; 84/601; 84/602; 84/604

[58] Field of Search ..... 84/1.28, 1.25, DIG. 2, 84/1.01, 1.03, 601, 602, 603–607, 615, 617, 626, 628, 629

[56] References Cited

U.S. PATENT DOCUMENTS 4,157,049 6/1979 Watanabe ..... 84/1.01 X
4,174,649 11/1979 Obayashi et al. ..... 84/606
4,287,802 9/1981 Imamura et al. ..... 84/1.01
4,338,843 7/1982 Wise ..... 84/1.01
4,348,928 9/1982 Sakashita et al. ..... 84/1.01
4,602,546 7/1986 Shinohara ..... 84/1.03
4,614,983 9/1986 Usami ..... 84/1.01 X
4,615,024 9/1986 Usui ..... 84/1.01 X
4,667,556 5/1987 Hanzawa et al. ..... 84/1.28 X
4,681,008 7/1987 Morikawa et al. ..... 84/603
4,691,608 9/1987 Sasaki et al. ..... 84/603
4,696,214 9/1987 Ichiki ..... 84/603
4,785,707 11/1988 Suzuki ..... 84/1.28 X

*Primary Examiner*—A. T. Grimley
*Assistant Examiner*—Matthew S. Smith
*Attorney, Agent, or Firm*—Frishauf, Holtz, Goodman & Woodward

[57] ABSTRACT

Memory means is provided such that it is capable of reading and writing tone source control data for an available number of channels. Each channel time is divided into two divisions for instance. In the first half of each channel time, tone source control data for the channel corresponding to the current channel time is read out from the memory means, and in the second half of channel time tone source control data of a given designated channel for setting data is written in the memory means. In this way, tone source control data can be set speedily even if the polyphonic channels are increased in number. Further, with an increased number of polyphonic channels it is possible to synchronize the phase of each tone in a tone mixing mode even when a frequency change is caused by a pitch bender or a vibrato.

6 Claims, 16 Drawing Sheets

POLYPHONIC ELECTRONIC MUSICAL INSTRUMENT

BACKGROUND OF THE INVENTION

1. Field of the Invention

This invention relates to a polyphonic electronic musical instrument, which can simultaneously generate a plurality of musical tones through a time-division process and, more particularly, to a tone source circuit of such a polyphonic electronic musical instrument.

2. Description of the Related Art

Heretofore, digital electronic musical instruments such as digital synthesizers have been well known in the art, which make use of digital techniques to generate musical tones electronically.

Such digital electronic musical instruments are suited for constructing a polyphonic electronic musical instrument, which can simultaneously generate a plurality of tones, with less circuit elements because the circuit of such instruments can be driven on a time-division basis.

In the prior art polyphonic electronic musical instrument, however, the tone source control data, i.e., sounding on/off signal, frequency data, envelope data and tone waveform access address data, are held in a shift register having a plurality of stages corresponding in number to the number of maximum number of tones that can be generated simultaneously (i.e., number of polyphonic channels). Therefore, the re-writing of data requires a waiting time corresponding to one cycle period of the shift register, which shifts data channel by channel, in the worst case. Although the waiting time does not pose any problem so long as the number of channels is small. However, when the channels are increased in number, the waiting time per channel is increased, leading to a delay of the tone source process after detection of a key-"on" or key-"off".

Further, when effecting a frequency change by providing a pitch bend or vibrato at the time of the tone mixing, the following problem takes place.

It is assumed that a pitch bend operator is operated with respect to the waveform data of each channel at the time of tone mixing of waveform data for sounding by using 1-st and 32-nd channels for a tone. In this case, in response to this operation a plurality of frequency data are successively provided each for each channel. At this time, every time one frequency data is given to each channel, the 1-st and 32-nd channels are turned on for frequency data updating and then turned off. However, since the system has a total of 32 channels, it takes a long time until the process goes from the 1-st channel to the 32-nd channel. Therefore, new frequency data is given before the updating of the frequency data of the 32-nd channel after the updating of the frequency data of the 1-st channel. In this case, the preceding frequency data given for the 32-nd channel is skipped to be updated to the new frequency data of this time, that is, the data of the 1-st channel is altered to the preceding frequency data while the data of the 32-nd channel is altered to the frequency data of this time, these altered data being tone-mixed for simultaneous sounding. In this way, the change of data of the tone-mixing channels result in a phase deviation of the frequency data.

SUMMARY OF THE INVENTION

A primary object of the invention is to provide an electronic musical instrument, which permits speedy tone source control data alteration even with an increased number of polyphonic channels.

Another object of the invention is to provide an electronic musical instrument, in which when effecting a frequency change with respect to tone-mixing channels by providing a pitch bend or a vibrato the tone phase of each pertinent channel is synchronized even with an increased number of polyphonic channel number.

According to one aspect of the invention, there is provided a polyphonic electronic musical instrument for simultaneously generating and sounding a plurality of tones through a time-division process on a plurality of channels, comprising:

first memory means for temporarily storing waveform data;

second memory means for storing tone source control data including access data for accessing the first memory means for each channel such that the stored data can be randomly accessed;

allotting means for successively allotting on a time-division basis a channel time for each of a plurality of channels as a process time of that channel;

dividing means for dividing each channel time allotted by the allotting means into a plurality of divisions; and read/write control means functioning in at least one division of time provided by the first dividing means to access the first memory means by reading out tone source control data corresponding to the current channel time from the second memory means and also functioning in at least one of the remaining divisions of time to write tone source control data of a given channel designated at that time to be changed in an area of the second memory means corresponding to the given channel.

According to another aspect of the invention, there is provided a polyphonic electronic musical instrument for simultaneous generation and sounding of a plurality of tones through a time-division process on a plurality of channels, comprising:

first memory means for storing sounding on/off data for each channel such that the stored data can be randomly accessed;

second memory means for storing frequency data for each channel such that the stored data can be randomly accessed;

third memory means;

fourth memory means;

transfer means for transferring sounding on/off and frequency data stored for each channel in the first and second memory means to the third and fourth memory means in one time-division cycle for each the memory means; and tone generation means for generating tones according to the sounding on/off and frequency data transferred for each channel to the third and fourth memory means.

DETAILED DESCRIPTION OF THE PREFERRED EMBODIMENTS

Figure 1:
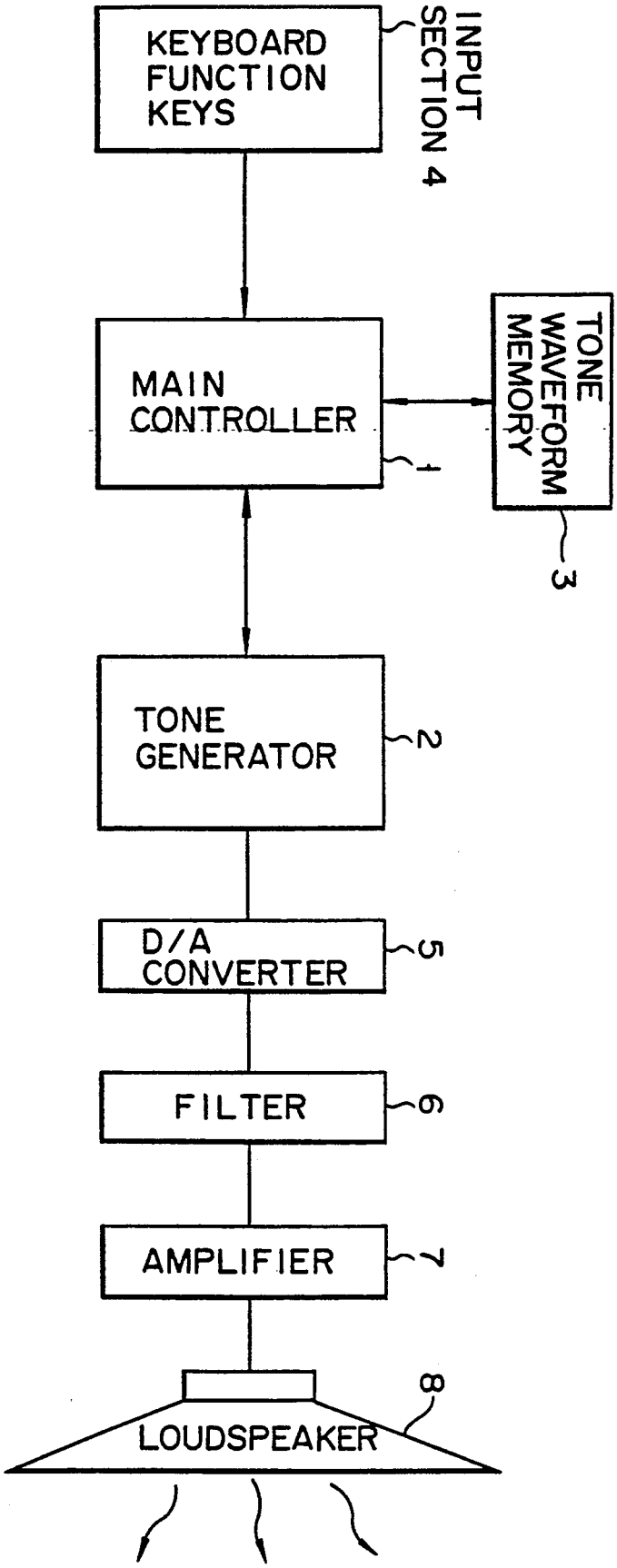
FIG. 1 is a block diagram showing the overall circuit of an electronic musical instrument.

FIG. 1 shows the overall circuit construction of the electronic musical instrument.

In this electronic musical instrument, under control of main controller 1, tone generator 2 reads out, by time-division basis, 32-channel tone waveform data stored in tone waveform memory 3 and effects various tone-color-imparting processes on the read-out data for sounding.

At this time, the tone waveform data read out by tone generator 2 is restricted by data from input section 4. Input section 4 has a keyboard and function keys. When keys of the keyboard are depressed, pitch data assigned to the depressed keys are generated, so that the tone waveform data is given frequencies corresponding to the generated pitch data, and pitches are determined in this way. The function keys designate the rhythm, chord progression, etc, and tone waveform data is read out from tone waveform memory 3 according to the designation.

In tone waveform memory 3, tone waveform data for melody, rhythm, chord progression, etc. have been stored. As the tone waveform data for melody, sawtooth wave or like data which can realize spectra containing a number of harmonic components, e.g., violin tones, is stored. The tone waveform data for melody is 12-bit data stored in 12-bit memory areas. The tone waveform data for bass, rhythm and chord progression is 8-bit data stored in 8-bit memory areas.

Tone waveform data provided from tone generator 2 is converted by D/A converter 5 into serial data, then smoothed by filter 6 and then amplified by amplifier 7 to be converted by loudspeaker into a sound signal.

TONE GENERATOR 2

Figure 2:
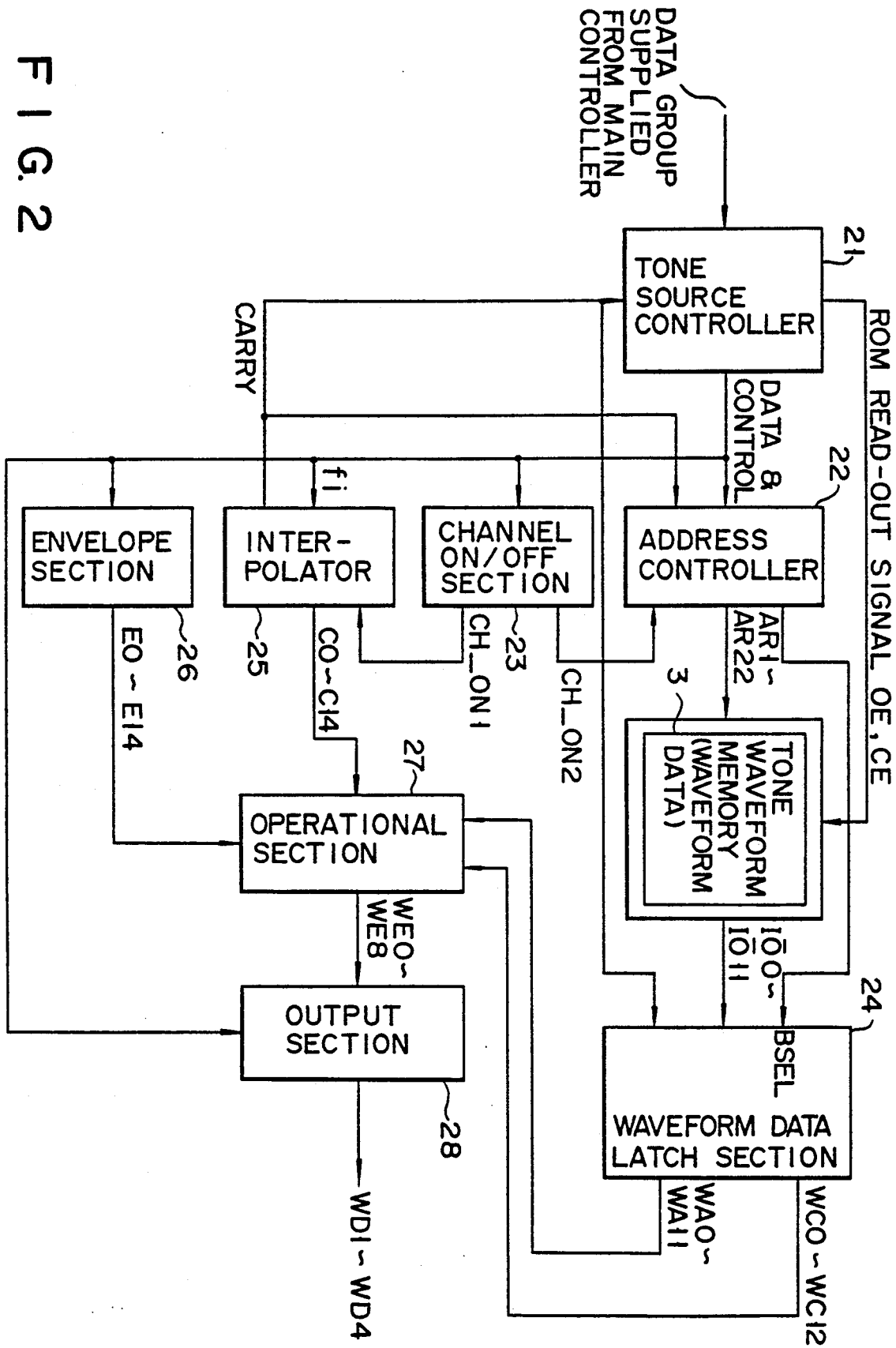
FIG. 2 is a block diagram showing a tone generator in the circuit of FIG. 1.

FIG. 2 shows tone generator 2. As is shown, tone generator 2 includes tone source controller 21, address controller 22, channel on/off section 23, waveform data latch section 24, interpolator (frequency controller) 25, envelope section 26, operational section 27 and output section 28. In the figure, tone waveform memory 3, which is actually provided outside tone generator 2, is shown to facilitate the understanding.

Tone source controller 21 rearranges command and other data supplied from main controller 1 and analyzes the commands to provide various control signals. Tone source controller 21 cyclically generates channel address signals B1 to B5 for time division control and signal B0 for dividing each channel time into first and second segments, and it further generates various system control clock signals.

Address controller 22 generates, on a time-division basis for each channel, address data for accessing tone waveform memory 3 according to channel address data B1 to B5 and data B0 provided from tone source controller 21. At this time, address controller 22 effects address control such that it starts reading of addresses from the start address, returns to a return address when addresses have been read up to the end address and repeatedly reading out addresses from the return address to the end address. Further, for speedily re-writing the start, return and end addresses, in the first half of each channel as determined by signal B0 it provides address data of channel corresponding to the channel time, and in the second half of channel it re-writes data to address data of a given channel designated at that time. In tone waveform memory 3, 8-bit and 12-bit tone waveform data is stored as noted before. Since the circuit of the system is used commonly for these tone waveform data consisting of different numbers of bits in such process as addition of these data, it is tone source control the 8-bit tone waveform data into 12-bit data by adding 4 bits. For this reason, the most significant bit of each address data is utilized as signal BSEL for discriminating whether 8- or 12-bit tone waveform data is stored in an address area. More particularly, if the most significant bit BSEL is "0", it signifies address data for 8-bit tone waveform data, while if it is "1", it signifies address data for 12-bit tone waveform data. When tone waveform data is read out according to the address data, signal BSEL is provided together with the read-out tone waveform data.

Channel on/off section 23 stores a channel on/off signal provided from tone source controller 21 and designating either the "on" or "off" state of each channel and provides a channel on/off signal for each channel according to channel address data B1 to B5. Further, when a frequency change is effected according to a pitch bender or a vibrator at the time of tone mixing, phase deviation of each channel assigned to a tone at the time of tone mixing is prevented even if there are a large number of channels as follows. The channel on/off signal is re-written in a predetermined area in the second half of a given channel time, and after the re-writing of data of all pertinent channels the channel on/off signals including those of re-written data are transferred to a different area. From this different area, the channel on/off signal of each channel is read out in the first half of the corresponding channel time to be provided to address controller 22, waveform data latch section 24, etc. In this way, the channel on/off signals from the other area noted above are utilized as effective data. Of course the sound generation processes such as reading of tone waveform data are not executed for any channel, for which the channel on/off signal is "off".

When signal BSEL of "0" is provided from address controller 22 together with 8-bit tone waveform data read out from tone waveform memory 3, waveform data latch section 24 effects a bit mask process on the 8-bit tone waveform data, so that this data is stored together with additional 4-bit redundant data. Waveform data latch section 24 further performs the following pre-process for obtaining an interpolation value between two tone waveform data corresponding to two consequtive addresses read out from tone waveform memory 3. That is, it calculates difference data between the two tone waveform data corresponding to the two consequtive addresses, and provides this difference data and tone waveform data corresponding to the younger one of the two addresses noted above to operation section 27.

Figure 12:
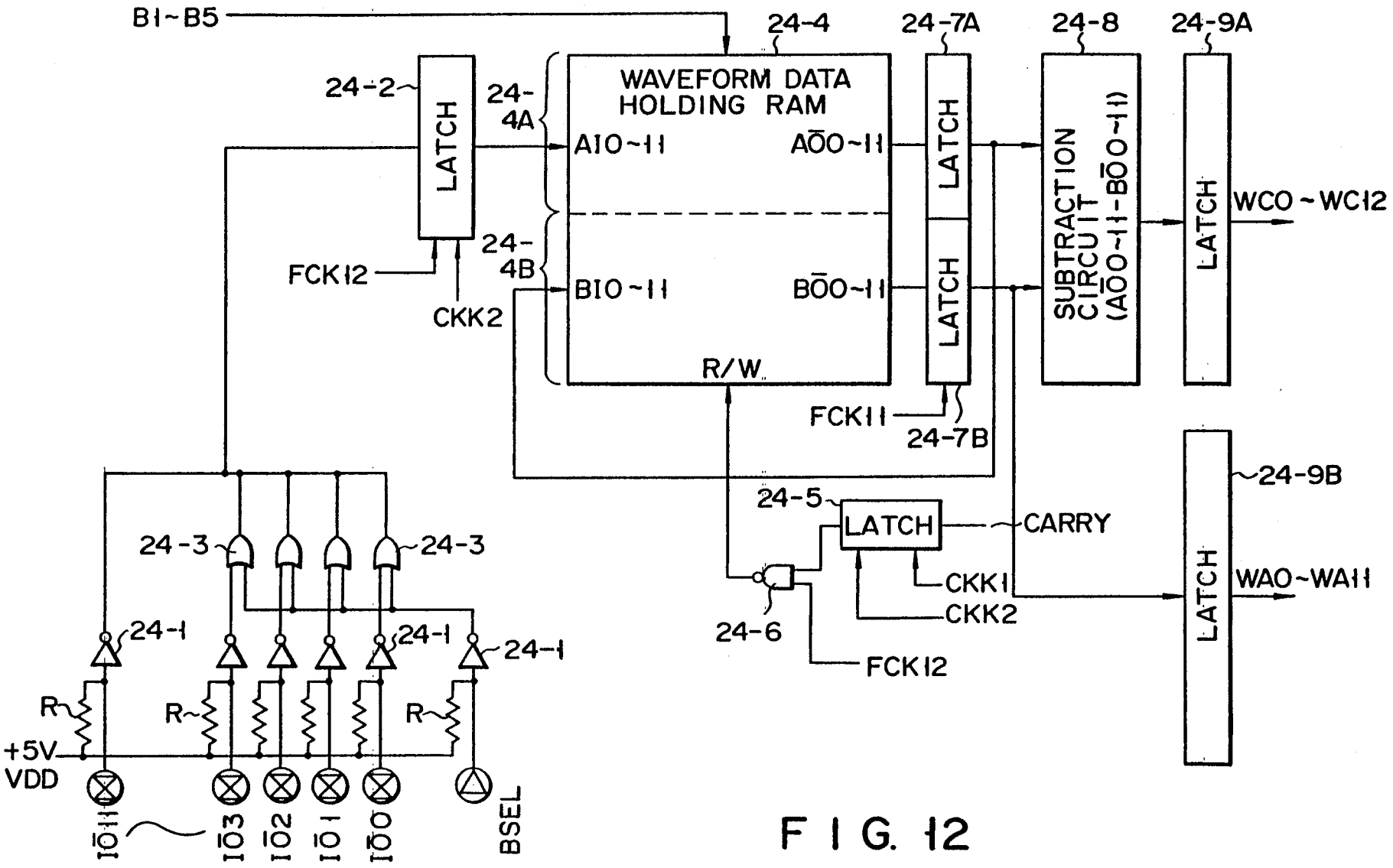
FIG. 12 is a schematic representation of a waveform data latch section in the circuit of FIG. 2.

As noted above, two tone waveform data are necessary for obtaining the interpolation value between two tone waveform data. However, if two tone waveform data are read out every time the interpolation segment is renewed, the channel time for one channel is increased, which is undesired when increasing the channel number. Accordingly, as shown in FIG. 12, waveform data latch section 24 is provided with current waveform memory 24-4A and preceding waveform memory 24-4B. When the interpolation segment is renewed, tone waveform data in current waveform memory 24-4A is transferred to preceding waveform memory 24-4B and subsequently tone waveform data corresponding to an upper rank sampling point (upper rank address when viewed from tone waveform memory 24-4A) of the renewed interpolation period is stored in current waveform memory 24-4A. In this way, it is made necessary to read out only a single tone waveform data at the time of the interpolation segment renewal. The difference data is calculated according to the tone waveform data from current and preceding waveform memories 24-4A and 24-4B to be provided together with the tone waveform data in preceding waveform memory 24-4B to operation section 27.

Figure 3:
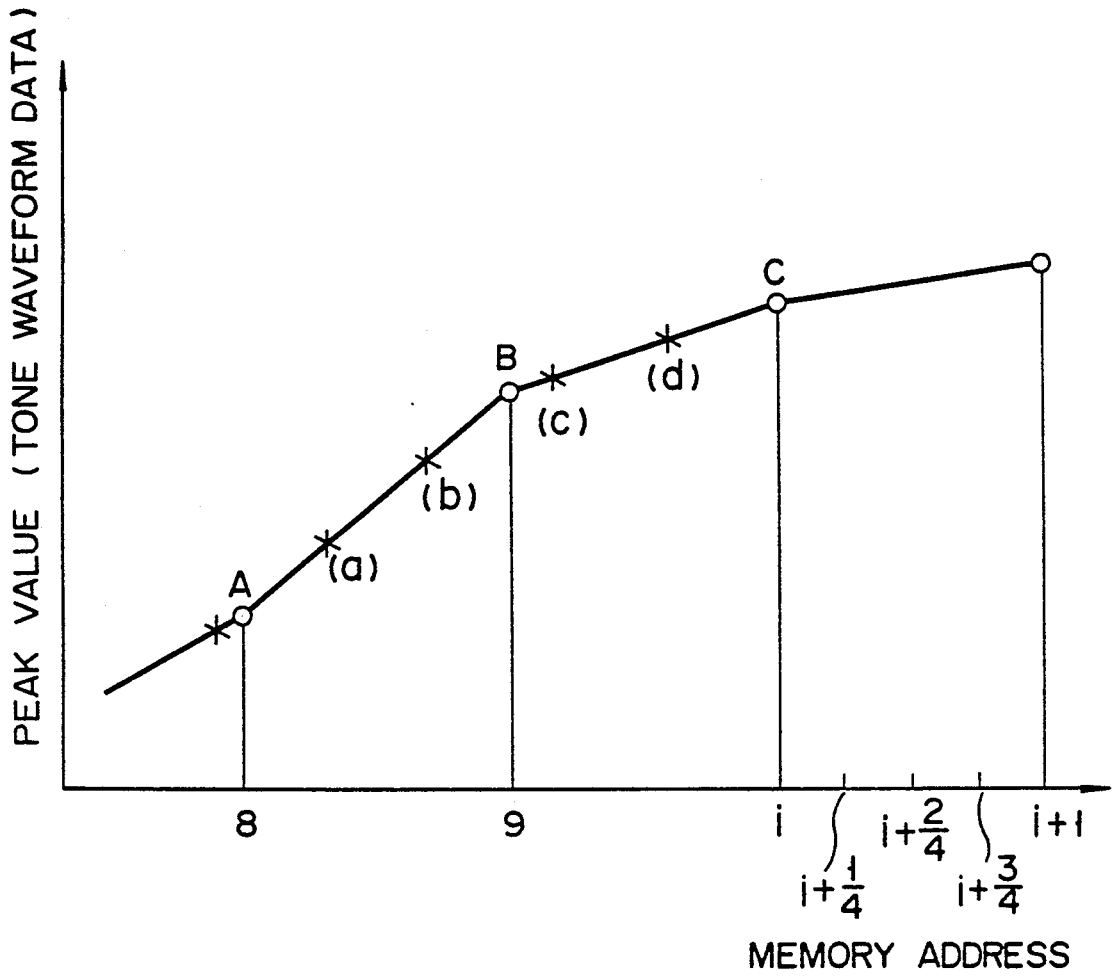
FIG. 3 is a view for explaining the content of a process of an interpolator in the circuit of FIG. 2.

Interpolator (frequency controller) 25 stores frequency (or pitch) parameter fi of each channel provided from tone source controller 21 and generates the interpolation data as noted above according to this frequency parameter fi. The frequency parameter fi provided from tone source controller 21 is in the following form. If it is desired to obtain a tone waveform at a frequency suited for interpolation of tone waveform data corresponding to addresses i and i+1 as shown in FIG. 3 at sampling points of $\frac{1}{4}$, 2/4 and $\frac{3}{4}$ (corresponding to addresses $i+\frac{1}{4}$, i+2/4 and $i+\frac{3}{4}$), frequency parameter fi is 0.25. Then, interpolator 25 provides values C0 to C14 equal to frequency parameter fi (0.25), twice fi, three times fi and so forth to operation section 27 every time each channel time arrives.

Further, in order that phase deviation does not occur in each channel assigned to a tone at the time of the tone mixing, interpolator 25, like channel on/off section 23, has RAMS like temporary and effective data areas.

Envelope section 26 generates an envelope signal and provides it to operation section 27 according to envelope data from tone source controller 21. The envelope data is provided on a time-division basis for each channel, so that the envelope is generated and provided on a time-division basis for each channel.

Operation section 27 effects multiplication on a time-division basis for each channel of difference data from waveform data latch section 24 and frequency parameter (interpolation parameter) data C0 to C14 from interpolator 25 and adds tone waveform data (corresponding to a lower rank sampling point in the interpolation section) from waveform data latch section 24 to the resultant product. Operation section 27 multiplies this sum by the envelope from envelope section 26 and provides the product to output section 28.

The tone waveform data from operation section 27 has been obtained after the interpolation according to frequency parameter data C0 to C14, and its frequency, i.e., pitch, is determined by frequency parameter data C0 to C14.

Output section 28 takes the sum of tone waveform data from operation section 27 group by group according to an output pattern signal provided from tone source controller 21 and representing a group pattern, in which the individual channels are grouped in groups. At this time, the intrinsic data length of each channel tone waveform data that is added varies in dependence on the number of channels in the group and digit number of D/A converter 5. More specifically, the effective data length of tone waveform data that is added is optimized for group by group in a range not exceeding the process capacity (digit number) of D/A converter 5.

TONE SOURCE CONTROLLER 21

Figure 4:
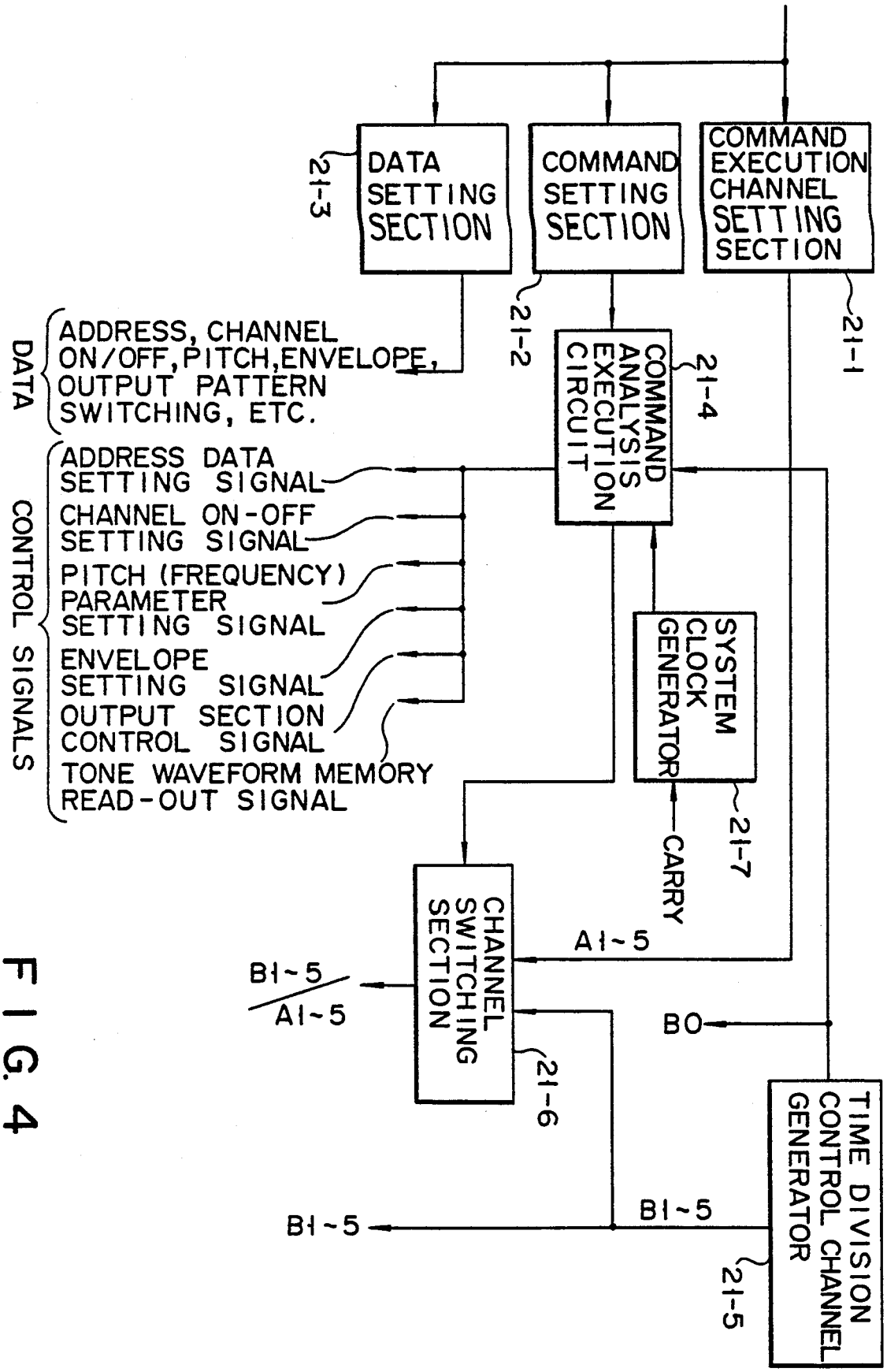
FIG. 4 is a block diagram showing a tone source controller in the circuit of FIG. 2.

FIG. 4 shows tone source controller 21 in detail. It includes command execution channel setting section 21-1, command setting section 21-2, data setting section 21-3, command analysis execution circuit 21-4, time division control channel generator 21-5, channel switching section 21-6 and system clock generator 21-7.

The rank No. of a sounding channel, for which a current command from main controller 1 is to be executed, is set in command execution channel setting section 21-1, a command to be executed this time is set in command setting section 21-2, and data concerning the command to be executed this time is set in data setting section 21-3. When the start address of the 32-nd channel, for instance, is to be re-written, channel rank No. 32 is set in command execution channel setting section 21-1, a write command is set in command setting section 21-2, and write start address data is set in data setting section 21-3. It is possible to set channel on/off data, frequency parameter data, output pattern switching data, etc. in lieu of the data noted above in data setting section 21-3.

Command analysis execution circuit 21-4 analyzes the command set in command setting section 21-2 and provides various control signals according to the result of analysis. The control signals include an address data setting signal, a channel on/off setting signal, a frequency (or pitch) parameter setting signal, an envelope setting signal, an output control signal and a tone waveform section read signal.

Figure 5:
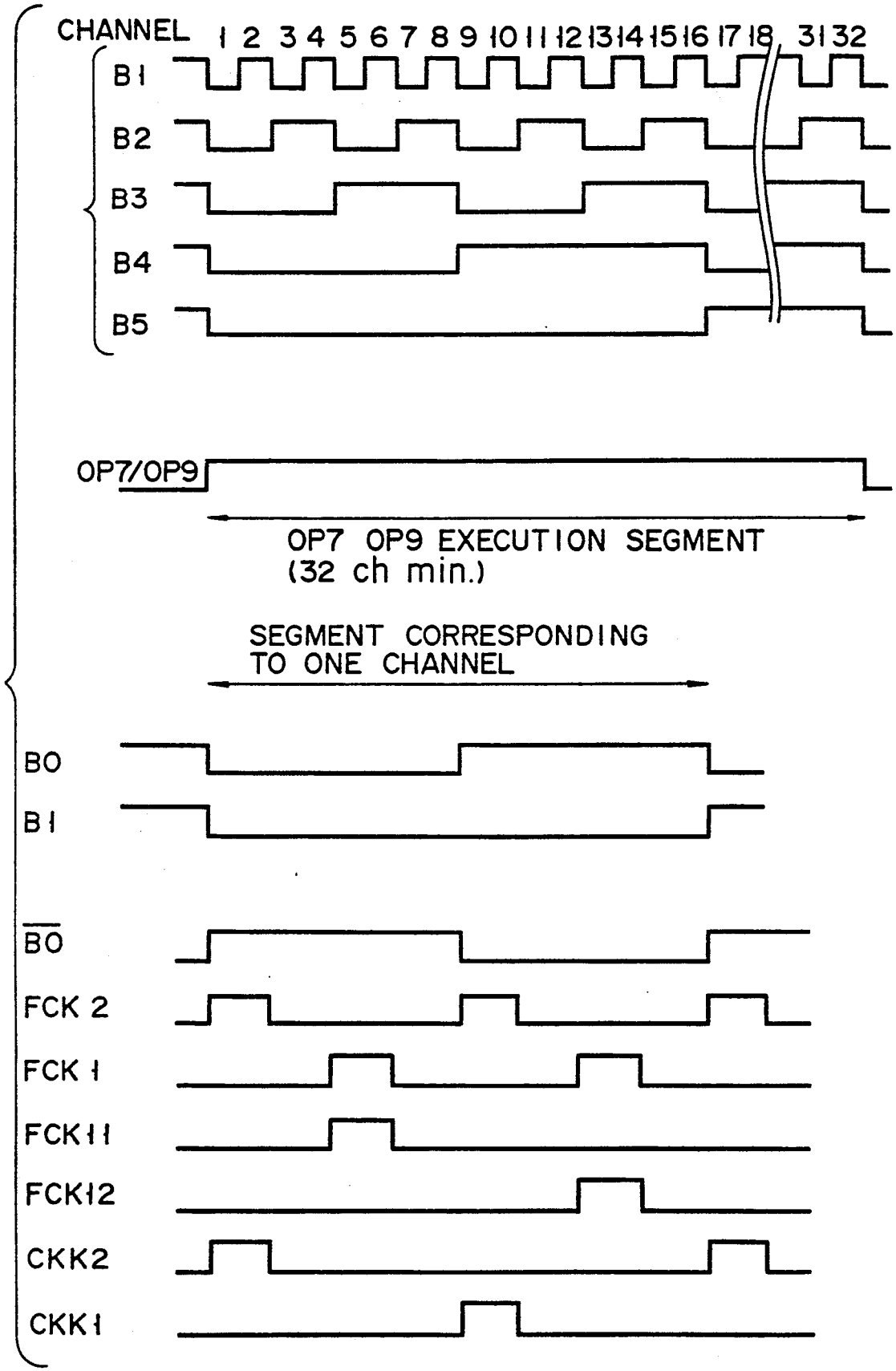
FIG. 5 is a time chart showing various time-division control signals generated by the tone source controller.

Time division control channel generator 21-5 cyclically generates read channel address signals B1 to B5 and signal B0 for dividing each channel time into the first and second halves as shown in FIG. 5. Read channel address signals B1 to B5 each represent a channel rank No. as is apparent from FIG. 5, and they function as channel time assignment signals, which can indicate a channel for reading out data therefrom and also effect time division control of the 32 channels.

Channel switching section 21-6 provides read channel address signals B1 to B5 in the first half (i.e., the "L" level period of signal B0) of a command execution segment (corresponding to one cycle of signal B0), and in the second half it provides write channel address signals A1 to A5 supplied from command execution channel setting section 21-1. Output signals from channel switching section 21-6 are supplied to address controller 22, channel on/off section 23, interpolator 25 and envelope section 26. Write channel address signals A1 to A5 represent the rank No. of a sounding channel for writing data therefor.

System clock generator 21-7 generates system control clock signals FCK2, FCK1, FCK11, FCK12, CKK2 and CKK1 as shown in FIG. 5 according to carry signal CARRY. Carry signal CARRY will be described later.

ADDRESS CONTROLLER 22

Figure 6:
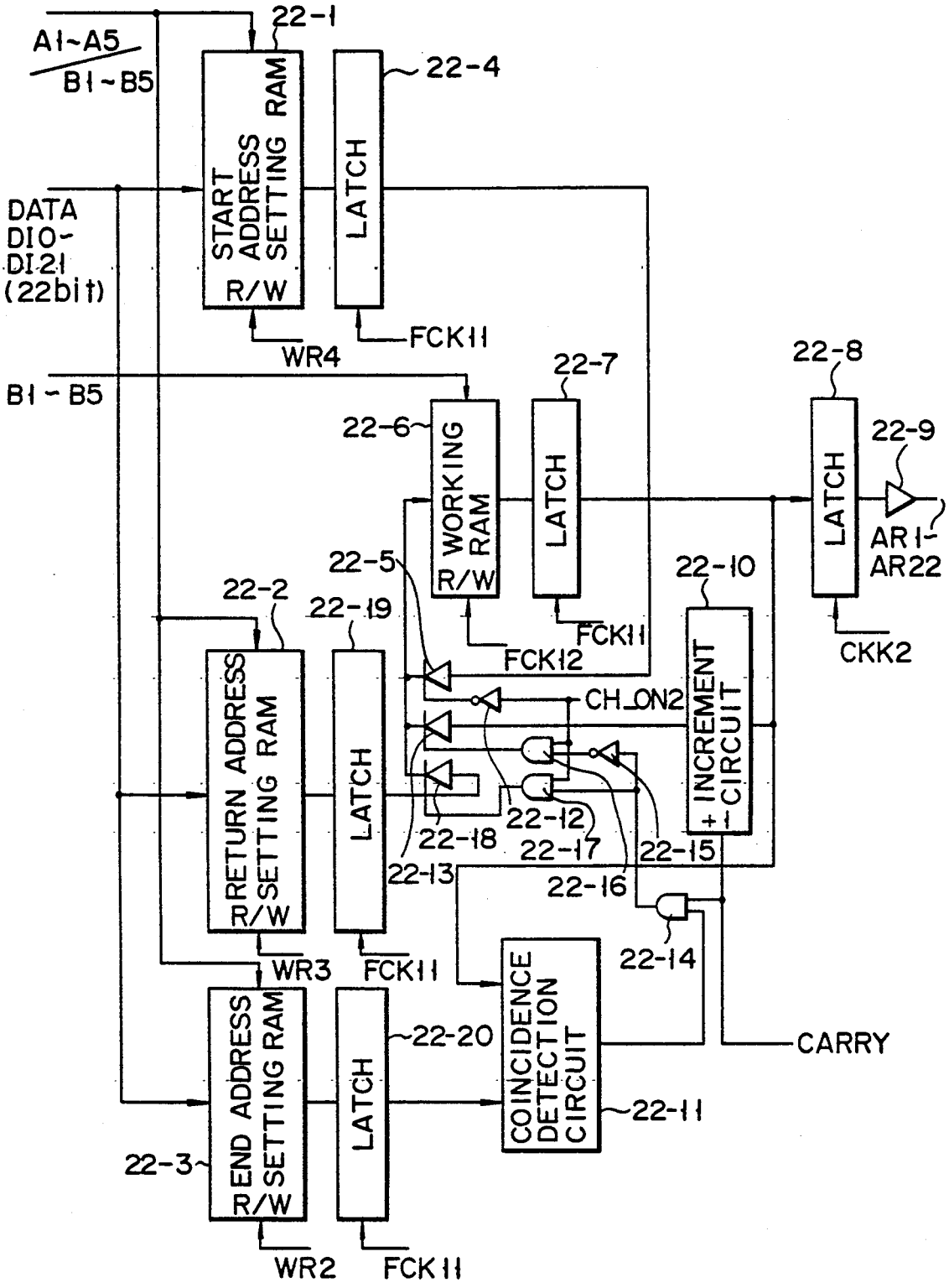
FIG. 6 is a schematic representation of an address controller in the circuit of FIG. 2.

FIG. 6 shows address controller 22 in detail. It includes start address setting RAM 22-1, return address setting RAM 22-2 and end address setting RAM 22-3. These RAMs each has an area for storing address data (22-bit data DI0 to DI21) for the 32 channels, and one address data is stored for each address. These data are read out in the first half of read channel address signals B1 to B5 from channel switching section 21-6.

Figure 7:
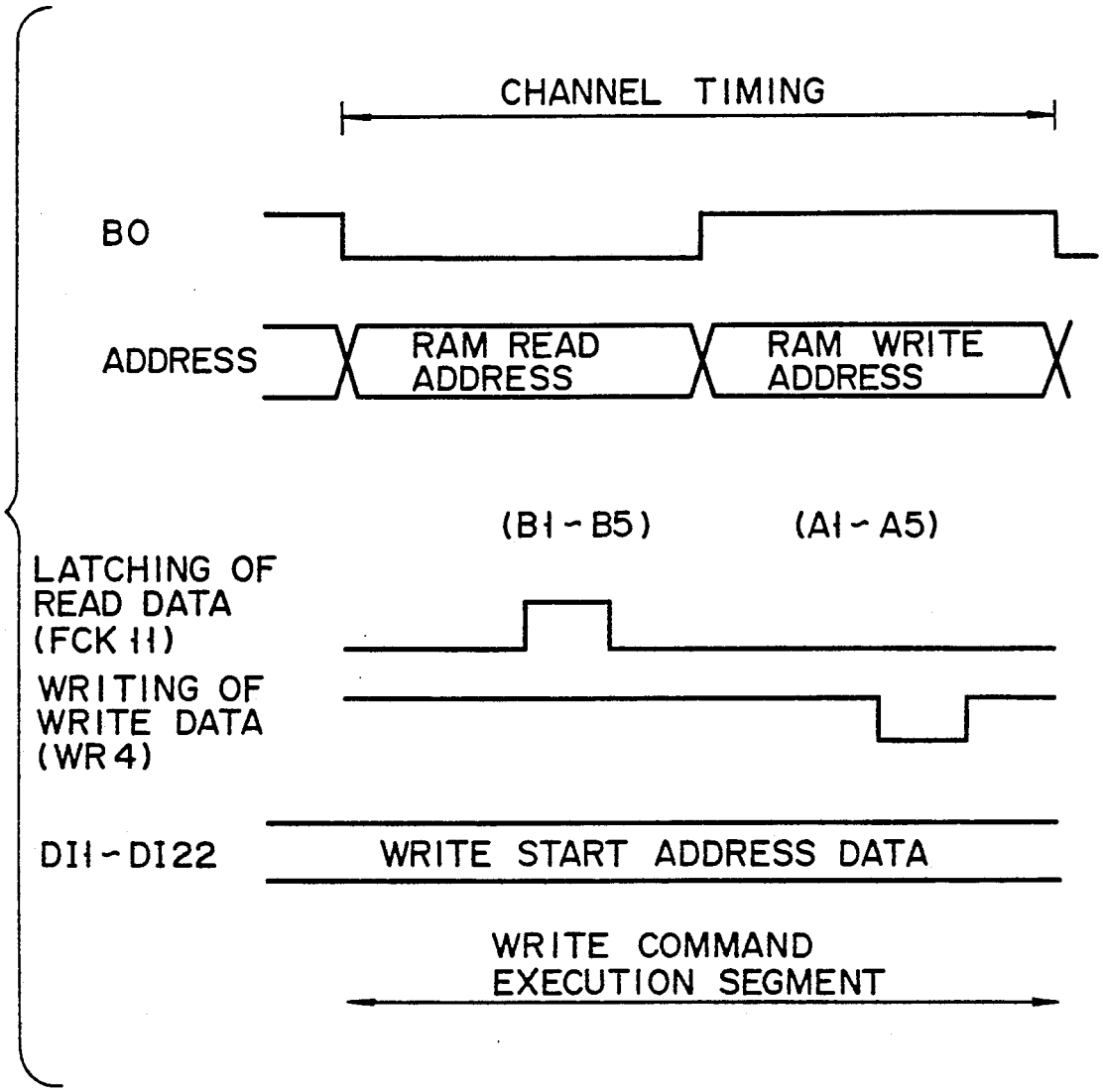
FIG. 7 is a time chart for explaining the operation of the address controller.

It is now assumed that a start address write command is given to tone source controller 21 during execution of a read command. At this instant, read channel address signals B1 to B5 are being supplied to start address setting RAM 22-1 from channel switching section 21-6. The start address data of the channels corresponding to read channel address signals B1 to B5 is successively latched on a time-division basis in latch 22-4 under the control of signal FCK11 in the first half of the channel time (signal B0). When the write command noted above is analyzed by command analysis execution circuit 21-4 in this state, channel switching section 21-6 provides write channel address signals A1 to A5 to start address setting RAM 22-1 in the second half of the current channel time. At this time, start address data (DI0 to DI21) has been supplied from data setting section 21-3 or start address setting RAM 22-1, and command analysis execution circuit 21-4 supplies start address write signal ~WR4 (which is an address data setting signal) in the second half of the current channel time. In consequence, under the control of start address write signal ~WR4 as shown in FIG. 7 (i.e., the "L" level portion of the signal) the start address data is written into start address setting RAM 22-1 in addresses thereof corresponding to write channel address signals A1 to A5. Start address write signal ~WR4 is one form of start address read/wrote signal, and when it is at the "L" level, it is particularly called start address write signal ~WR4. When it is at the "H" level, it is start address read signal ~WR4. The symbol "~" as in ~WR4 signifies a negative logic that the pertinent signal is active when it is at the "L" level.

It will be understood that even if the current channel time is assigned to a channel other than a channel, for which writing of data is to be done, writing of data for a given channel is effected in the second half of the current channel time. Thus, the process of writing data (i.e., execution of a command) can be effected without need of waiting for the arrival of the channel time of the channel, for which the data-writing process is to be done. Therefore, it is possible to effect the tone source process in due time even with an increased channel number such as the 32 channels as in this embodiment. The write process is effected in the same way for the return and end addresses as for the start address.

Start address data DI0 to DI21 latched in latch 22-4 is stored on a time-division basis and in correspondence to channels in working RAM 22-6 through tri-state buffer 22-5 under control of signal FCK11 and read channel address signals B1 to B5. Start address data DI0 to DI21 stored in working RAM 22-6 is latched in latch 22-7 under control of signal FCK11 and latched in 22-8 under control of signal CKK2 to be supplied as address data AR1 to AR22 through buffer 22-9 to tone waveform memory 3.

Start address data DI0 to DI21 latched in latch 22-7 is also supplied to increment circuit 22-10 and coincidence detection circuit 22-11. When signal CH-ON2 goes to "H", tri-state buffer 22-5 is disabled through inverter 22-12, so that the supply of the start address data to working RAM 22-6 is discontinued. Meanwhile, with the disabling of tri-state buffer 22-5, interpolator 25 provides carry signal CARRY every time the interpolation of peak value data between adjacent addresses (i.e., sampling points) stored in tone waveform memory 3 is ended. Every time carry signal CARRY is provided, increment circuit 22-10 increments start address data DI0 to DI21 by "1", the result data being stored in working RAM 22-6 through tri-state buffer 22-13. The result data is supplied through latch 22-7 to tone waveform memory 3, increment circuit 22-10 and coincidence detection circuit 22-11. Coincidence detection circuit 22-11 compares end address data from end address setting RAM 22-3 and incremented address data and, if the two compared data coincide, provides an "H"-level coincidence signal. With this coincidence signal and carry signal CARRY, AND gate 22-14 is enabled to provide an enable signal, which is supplied through inverter 22-15 to AND gate 22-16 and also directly to AND gate 22-17. At this time, signal CH-ON2 at "H" level has been supplied to AND gates 22-16 and 22-17. Thus, at this time tri-state buffer 22-13 is disabled, while tri-state buffer 22-18 is enabled, so that return address data from return address setting RAM 22-2 is stored in working RAM 22-6. In other words, the return address is provided when address data from the start to the end address have been provided. Subsequently, when address data up to the end address have been provided, the process returns to the return address, and then data from the return to the end address are repeatedly provided.

Both the return and end address data in return and end address setting RAMs 22-2 and 22-3 are latched in latches 22-19 and 22-20 under control of signal FCK11 to be provided from these latches.

CHANNEL ON/OFF SECTION 23

Figure 8:
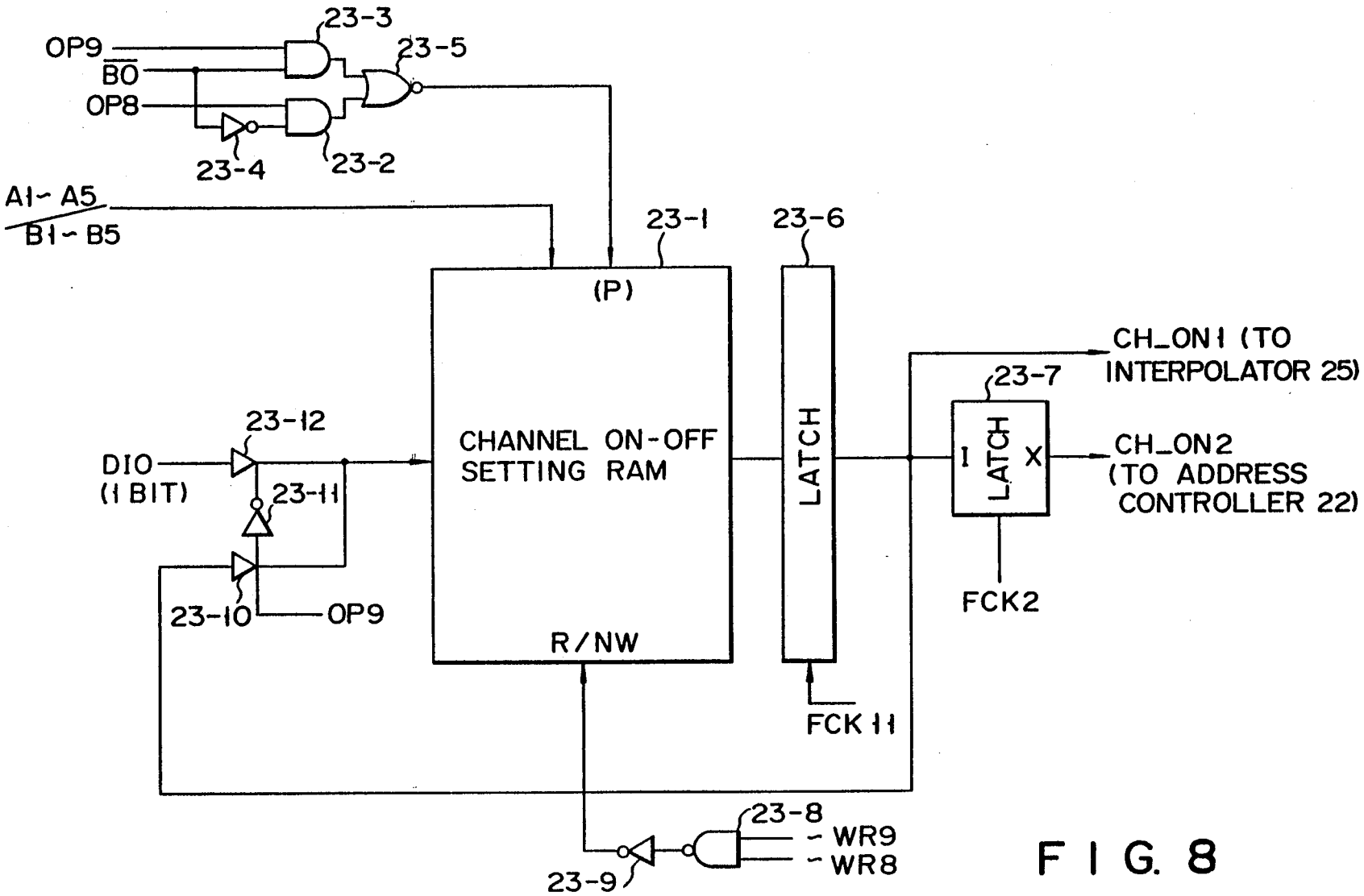
FIG. 8 is a schematic representation of a channel on/off section in the circuit of FIG. 2.
Figure 9:
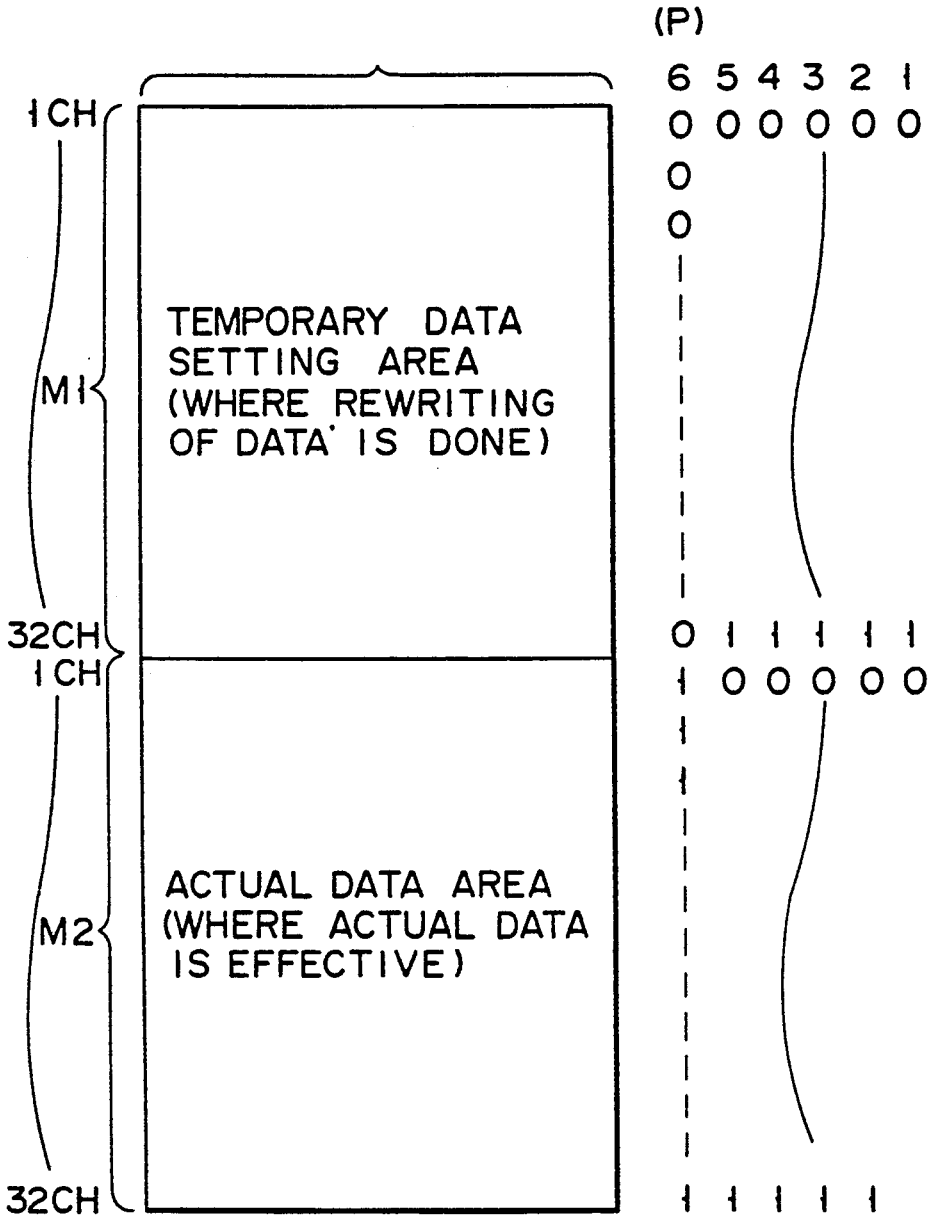
FIG. 9 is a view showing the configuration of a channel on/off RAM in the channel on/off section.

FIG. 8 shows channel on/off section 23 in detail It includes channel on/off setting RAM 23-1. Channel on/off setting RAM 23-1, as shown in FIG. 9, includes temporary data setting area Ml which is when re-writing channel on/off data and effective data area M2 for storing channel on/off data for each channel after re-writing, these areas being provided for phase synchronization of each channel of tone waveform assigned to a tone at the time of tone mixing. After channel "off" data for all channels concerning the tone mixing has been set in temporary data setting area Ml, the data set in this area is all transferred at a time to effective data area M2, and channel on/off data transferred to effective data area M2 is utilized as effective data. Most significant data P of address data representing temporary data setting and effective data areas M1 and M2 is respectively "0" and "1". The switching of the two areas is effected under control of most significant bit data P which is generated in a manner as will be described later.

Figure 10:
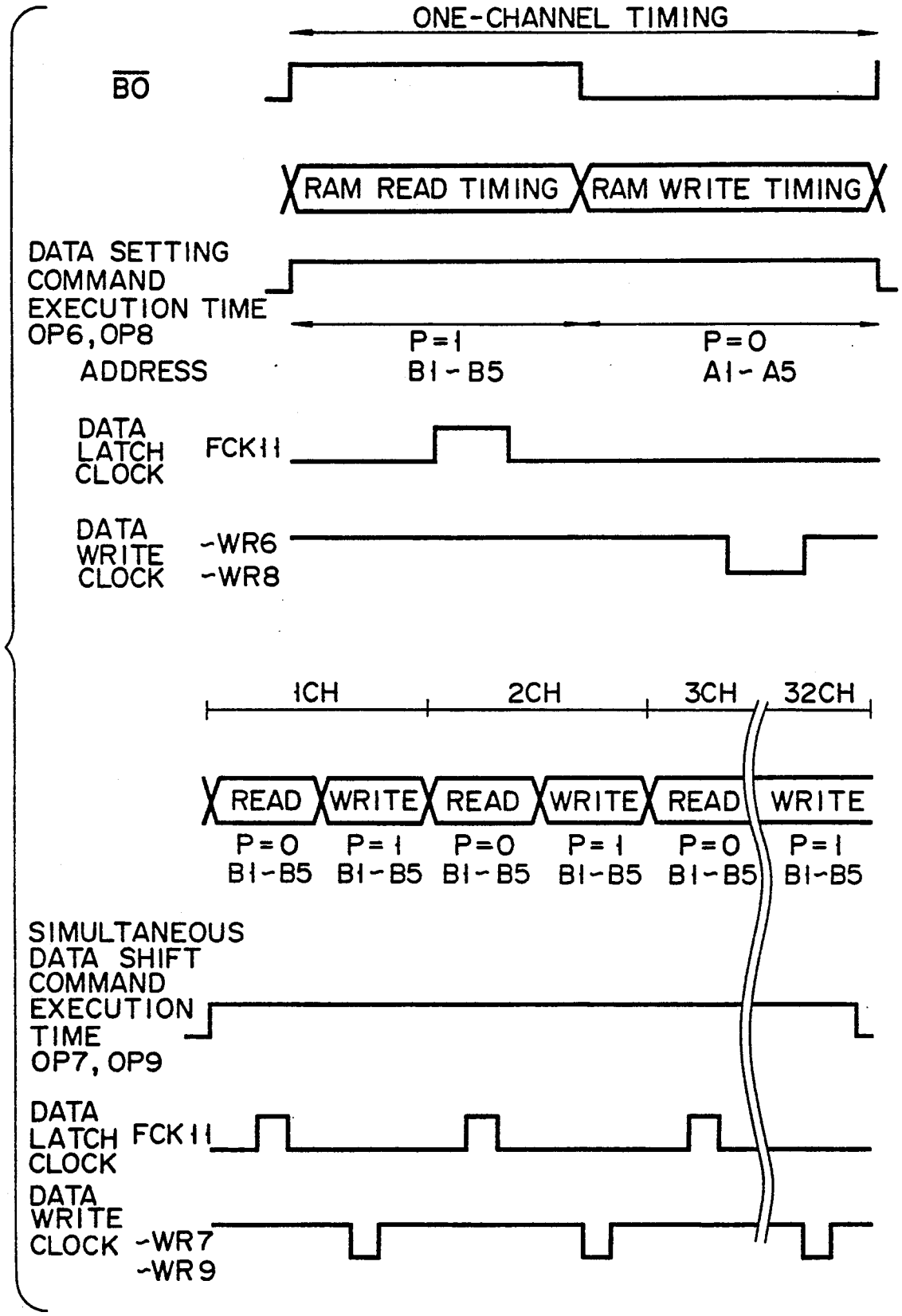
FIG. 10 is a time chart for explaining the operation of the channel on/off section.

When effecting tone mixing, it is necessary to set channel "off" data for a plurality of channels assigned to a tone. The setting is done as follows. In the first half of a command execution segment, read channel address signals B1 to B5 are transferred from tone source controller 21 to channel on/off setting RAM 23-1, and in the second half of the segment write channel address signals A1 to A5, channel on/off setting signal ~WR8 and channel "off" data (DI0: one bit) are transferred. Further, data setting command execution instruction OP8 and simultaneous data shift command execution instruction OP9 as shown in FIG. 10 are supplied to AND gates 23-3 and 23-2. Further, signal B0 obtained by inversion of signal B0 is supplied directly to AND gate 23-2 and supplied through inverter 23-4 to AND gate 23-3. Until the writing of channel "off" data of all the channels concerning the tone mixing is ended, the instruction data OP8 and OP9 are respectively "1" and "0". Therefore, until the writing of all the channel "off" data is ended, output P (i.e., most significant bit data P) of NOR gate 23-5 is "1" in the first half of the channel time and "0" in the second half. In the first half of the channel time effective data area M2 is designated, while in the second half temporary data setting area M1 is designated. Thus, as shown in FIG. 10, in the first half of the channel time the channel on/off data of the pertinent channel is read out from effective data area M2 and latched in latch 23-6 under control of signal FCK11, while in the second half of the channel time channel "off" data of a channel designated by write channel signals A1 to A5 is written in temporary data setting area M1 under control of channel on/off setting signal ~WR8. Signal ~WR8 is supplied through NAND gate 23-8 and inverter 23-9.

In the above way, channel "off" data can be written in temporary data setting area M1 without destruction of channel on/off data in effective data area M2 that is currently being utilized as effective data.

Subsequently, all the data in temporary data setting area M1 is simultaneously transferred to effective data area M2 in one time-division cycle. When the writing of channel "off" data of all the channels concerning the tone mixing is ended, data setting command and simultaneous data shift command execution instructions OP8 and OP9 go to "0" and "1", respectively. Thus, output P of NOR gate 23-5 is "0" to designate temporary data setting area M1 in the first half of the channel time, while it is "1" to designate effective data area M2 in the second half of the channel time. As shown in FIG. 10, in the first half of each channel time address data (corresponding to channel rank No.) is read out from temporary data setting area M1 under control of signal FCK11, and in the second half of the channel time the readout channel on/off data is written in addresses B1 to B5 of effective data area M2 under control of channel on/off setting signals B1 to B5. As such reading and writing is continuously performed for the 32 channels, all the data in temporary data setting area M1 is simultaneously transferred to effective data area M2 in one time-division cycle. The channel on/off data (channel "off" data being set for the channels concerning the tone mixing) that has been simultaneously transferred to effective data area M2, is latched in latch 23-6 in the first half of each channel time under control of signal FCK11 to be supplied as sounding on/off control signal for each channel to interporator 25.

The channel on/off signals latched in latch 23-6 are further latched in latch 23-7 under control of signal FCK2 to be provided as sounding on/off control signal CH-ON2 for each channel to address controller 22. Further, while the channel on/off data is being shifted simultaneously in the manner as noted above, data OP9 is "1", and tri-state buffer 23-10 is in the enabled state, so that signal CH-ON1 (which is based on the channel on/off signals before the re-writing) is fed back. In the other times, tri-state buffer 23-12 is held enabled by data OP9 (of "0") supplied through inverter 23-11, and channel on/off data from tone source controller 21 can be written.

INTERPORATOR (FREQUENCY CONTROLLER) 25

Figure 11:
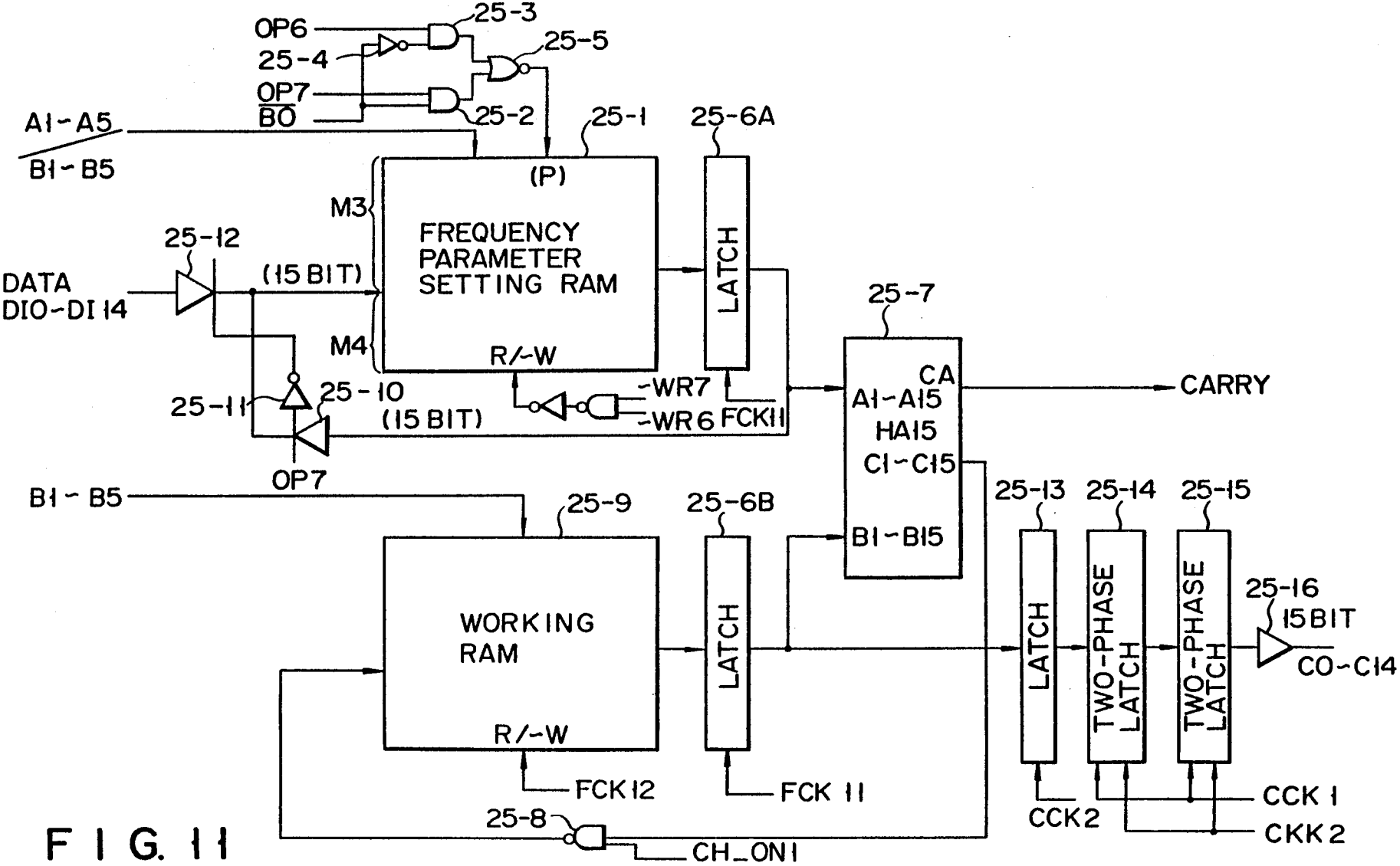
FIG. 11 is a schematic representation of an interpolator in the circuit of FIG. 2.

FIG. 11 shows interpolator 25 in detail. Frequency parameter setting RAM 25-1 for setting frequency parameter data fi, like channel on/off setting RAM 23-1, includes temporary data setting area M3 and effective data area M4. At the time of tone mixing, after frequency parameter data Fi of a plurality of channels assigned to one tone has been written in temporary data setting area M3, the frequency parameter data of all the channels is simultaneously transferred from temporary data setting area M3 to effective data area M4. To fulfill this function similar to the function of channel on/off section 23, AND gates 25-2 and 25-3, inverter 25-4, NOR gate 25-5, tri-state buffers 25-10 and 25-12 and inverter 25-11 are provided.

By the processes described so far, the prearrangements for the phase synchronization at the time of the sounding with respect to the channels concerning the tone mixing have been completed. At this time, however, channel "off" data is stored as channel on/off data for controlling the sounding on/off with respect to the channels concerning the tone mixing in effective data area M2 of channel on/off setting RAM 23-1. That is, the sounding with respect to the channels concerning the tone mixing is in the "off" state. Accordingly, the channel "off" data is re-written to channel "on" data with respect to the channels concerning the tone mixing in the manner as described before. In this way, the tone mixing can be obtained without phase deviation even if a frequency change such as the provision of a pitch bender or a vibrato is provided in the sounding state.

Further, interpolator 25 designates sampling points corresponding to interaddress decimal fraction addresses of peak values (tone waveform data) stored in tone waveform memory 3 like points a to d in FIG. 3 as interpolation points by accumulating frequency parameter data fi supplied from tone source controller 21. When there occurs a decimal point carry in the accumulation value, interporator 25 provides carry signal CARRY to control the timing of renewal of the interpolation segment (i.e., segments between points A and B and between points B and C). As shown in FIG. 3, the sampling points (a to d) corresponding to decimal fraction addresses need not be relatively like points in each interpolation segment and may be dependent on only the pitch of tone to be sounded. The greater the number of sampling points, i.e., the smaller the value of frequency parameter fi, the frequency or pitch is the higher.

More specifically, the frequency parameter data set in effective data area M4 of frequency parameter setting RAM 25-1 is latched in latch 25-6A under control of signal FCK11 to be supplied to one input terminal of half-adder 25-7. The supplied frequency parameter data is added to the preceding sum fed back to the other input terminal thereof and to added sum is fed through NAND gate 25-8 on/off controlled by signal CH-ON1 and written in working RAM 25-9 under control of signal FCK12. Subsequently, the written sum data is latched in latch 25-6B under control of signal FCK11 to be fed back to half-adder 25-7. The data in latch 25-6B is latched in latch 25-13 under control of signal CKK2 to be provided to and latched in two-phase latches 25-14 and 25-15 under control of signals CKK1 and CKK2 and then supplied as interpolation parameter data C0 to C14 through buffer 25-16 to operation section 27.

When the frequency parameter data accumulation operation yields a decimal point carry, half-adder 25-7 generates carry signal CARRY. The generation of carry signal CARRY signifies the timing of renewal of the interpolation segment as can be understood from FIG. 3. Carry signal CARRY thus generated is supplied to tone source controller 21 for generation of various clock signals, and it is also supplied to increment circuit 22-10 of address controller 22 to be utilized as timing signal for address progress, i.e., interpolation segment renewal.

WAVEFORM DATA LATCH SECTION 24

FIG. 12 shows waveform data latch section 24 in detail. This section produces 12-bit data by using as mask 8-bit data, e.g., rhythm pattern data, supplied from tone waveform memory 3. Input terminals IO0 to IO11 and terminal BSEL of waveform data latch section 24 are pulled-up by +5-volt supply voltage VDD and pull-up resistor R. The individual input signals are inverted by respective inverters 24-1 to be supplied to latch 24-2. In the case of 8-bit data, the individual 8 bits are respectively supplied to input terminals IO4 to IO11 and inverted by associated inverters 24-1, while the 4 bits corresponding to input terminals IO0 to IO3 are forcibly masked to "1". In other words, when 8-bit data is supplied, address controller 22 provides "0"-level signal BSEL, so that associated inverter 24-1 provides an output of "1", and the outputs of OR gates 24-3 corresponding to input terminals IO1 to IO3 are "1" at all time irrespective of the input signals to input terminals IO0 to IO3.

When 12-bit data is supplied, "1"-level signal BSEL is supplied so that associated inverter 24-1 provides an output of "0". Thus, the input signals to input terminals IO0 to IO3 are provided after inversion through associated OR gates 24-3.

In the above masking process, the number of effective bits of each channel tone waveform data of different bit numbers is switched to provide a constant data length, so that it is possible to permit simultaneous sounding of tone colors of different peak resolutions and hence reduce the memory capacity of tone waveform memory 3. It is possible to make the inverter output to be "0" instead of "1" in the above masking process.

Figure 13:
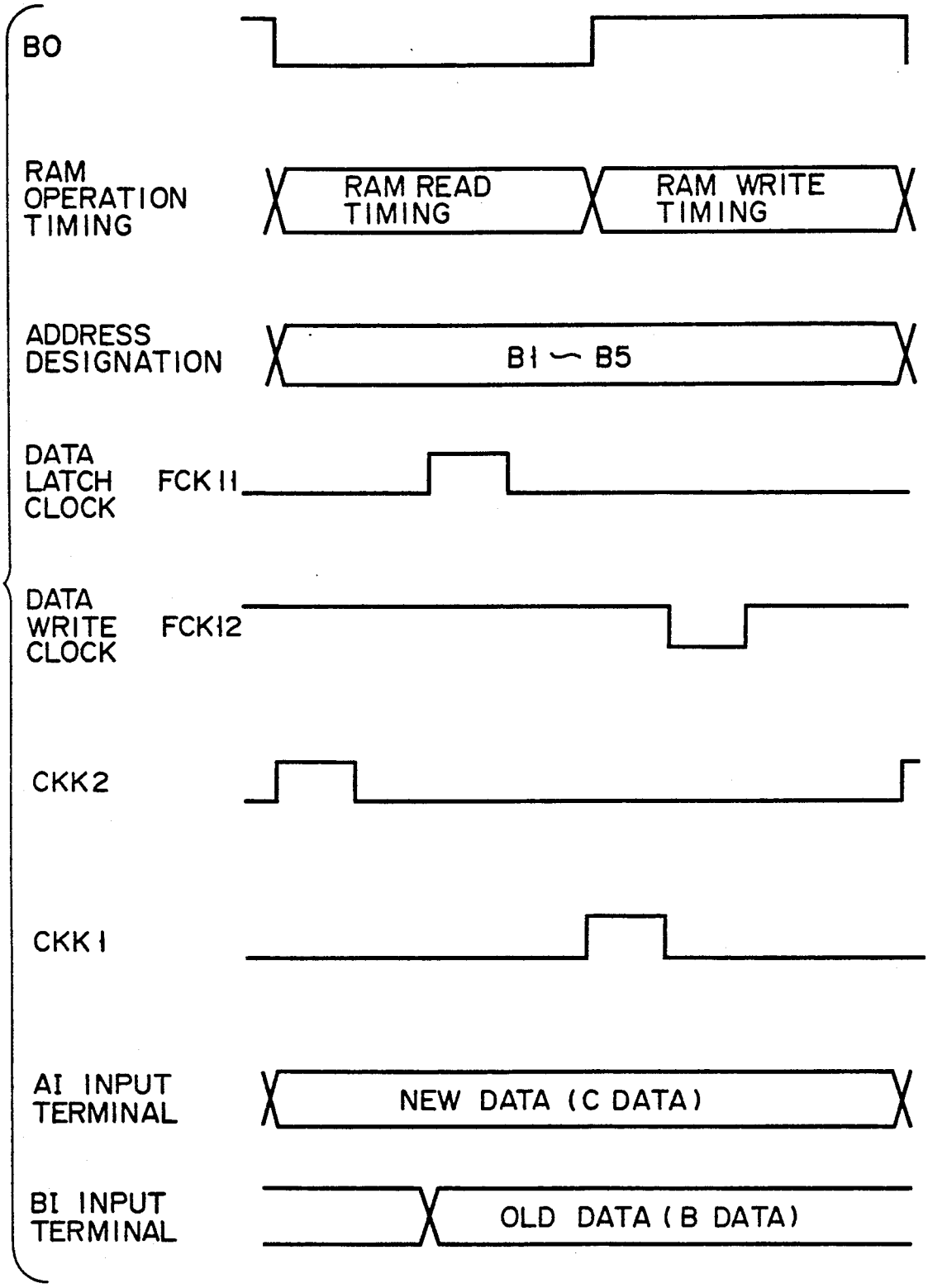
FIG. 13 is a time chart for explaining the operation of the waveform data latch section.

As shown in FIG. 13, 12-bit tone waveform data from input terminals IO0 to IO11 is latched in latch 24-2 under control of signal FCK12. Meanwhile, to read/write terminal R/W of waveform data holding RAM 24-4 are supplied output signals of latch 24-5, to which carry signal CARRY and signals CKK2 and CKK1 are supplied, and NAND gate 24-6, to which the output signal of latch 24-5 and signal FCK2 are supplied. Therefore, at the time when tone waveform data is latched in latch 24-2, signals CKK2 and CKK1 have not yet been generated, so that latch 24-2 provides no output, and no tone waveform data is written in waveform data holding RAM 24-4. Tone waveform data latched in latch 24-2 is provided from the same under control of signal CKK2 and written in channel addresses B1 to B5 of waveform data holding RAM 24-4A under control of signal FCK12. This tone waveform data written in waveform data holding RAM 24-2A corresponds to point C in FIG. 3, for instance, i.e., to an upper rank sampling point with respect to the current interpolation segment. Meanwhile, tone waveform data of point B, which corresponds to the upper end of the preceding interpolation segment (upper rank sampling point) and lower end of the current interpolation segment (lower rank sampling point) is read out from latch 24-7A under control of signal FCK11 and written in channel address B1 to B5 of waveform data holding RAM 24-4B under control of signal FCK12.

In the above way, tone waveform data at the upper and lower ends of the new interpolation segment is set in waveform data holding RAMs 24-4A and 24-4B. Besides, in the setting of the new interpolation segment it is necessary to read out only the upper end tone waveform data.

The upper and lower end tone waveform data is latched in respective latches 24-7A and 24-7B under control of signal FCK11. These latched data are supplied to subtraction circuit 24-8 for subtraction to obtain difference data WC0 to WC12. The difference data is latched in latch 24-9A under control of signal CKK2 to be provided to operation section 27. The lower end tone waveform data latched in latch 24-7B is latched in latch 24-9B under control of signal CKK2 to be provided as reference tone waveform data WA0 to WA11 to operation section 27.

ENVELOPE SECTION 26 AND OPERATION SECTION 27

These sections have been described in detail before in connection with tone generator 2, so their further description is not given here.

OUTPUT SECTION 28

Figure 14:
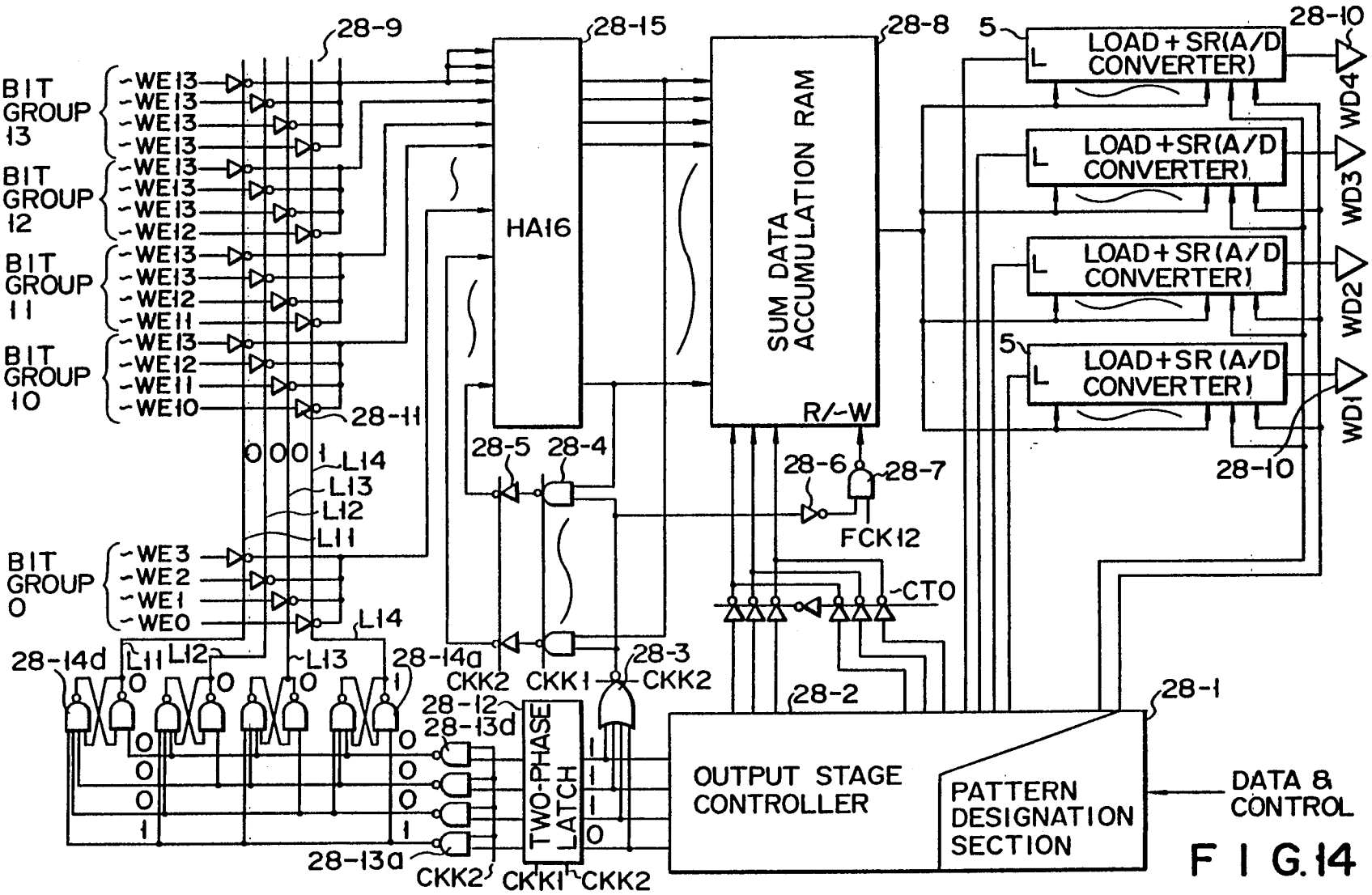
FIG. 14 is a schematic representation of an output section in the circuit of FIG. 2.

FIG. 14 shows output section 28 in detail. This section divides the 32 channels into a plurality of groups, adds tone waveform data of each group of channels and provides resultant sum data after D/A conversion. At this time, the effective data length of tone waveform data added together is optimized for each group in a range not exceeding the process bit number (i.e., 16 bits) of D/A converter 5 so as to be able to cope with carries produced in the addition.

Figure 15:
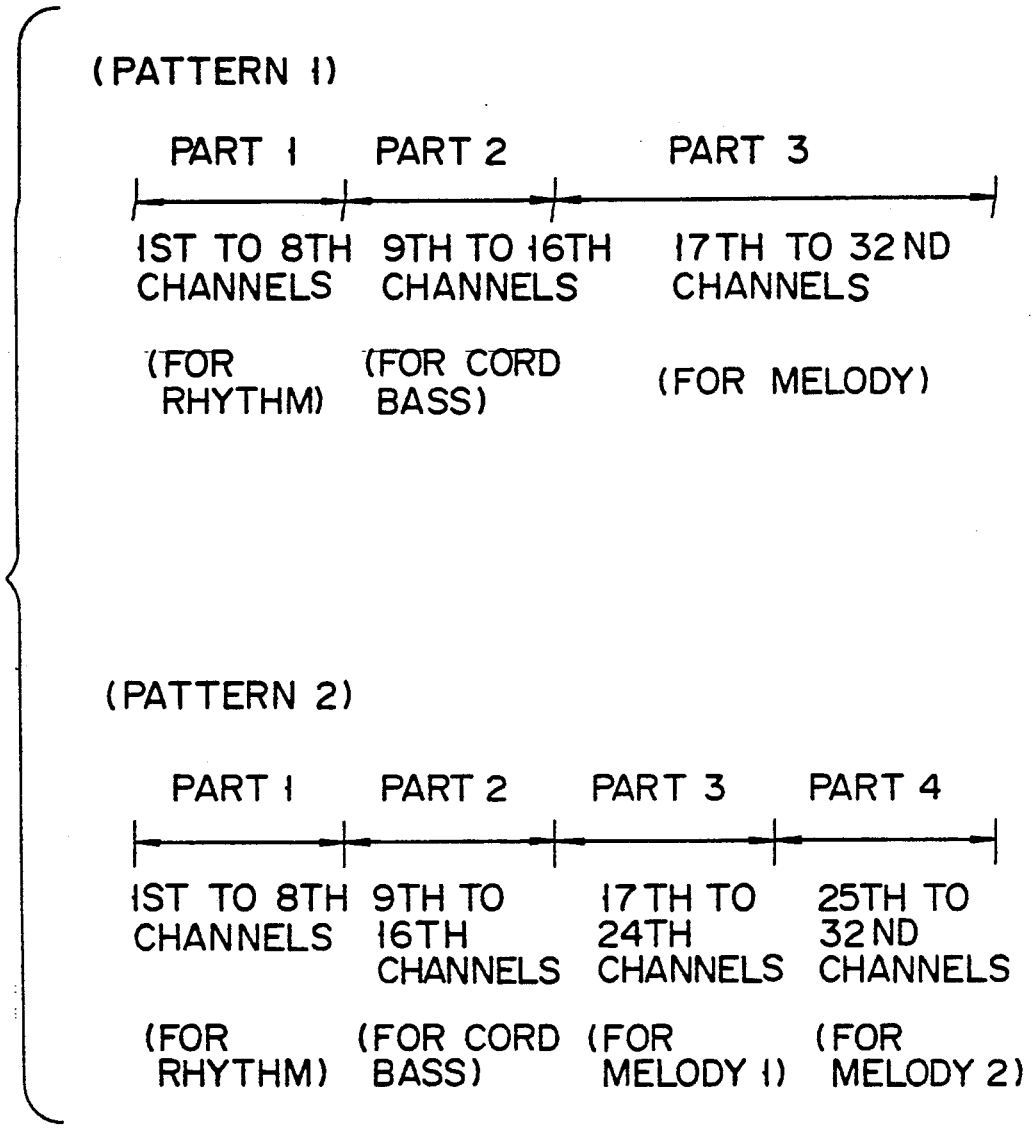
FIG. 15 is a view showing examples of the output pattern of the output section.

FIG. 15 shows examples of the grouping pattern. In pattern 1, the 32 channels are grouped in three groups, i.e., parts 1 to 3. Part 1 consists of 1-st to 8-th channels for rhythm. Part 2 consists of 9-th to 16-th channels for chord and bass. Part 3 consists of 17-th to 32-nd channels for melody.

It is now assumed that pattern 1 is set in pattern designation section 28-1 under control of an output control signal from tone source controller 21.

In this case, parts 1 and 2 each consist of 8 channels, the former from the 1-st to the 8-th channels and the latter from the 9-th to the 16-th channels. D/A converter 5 has 16 bits as noted before. Thus, in parts 1 and 2 tone waveform data of 8 channels is added together. In order that the result of this addition is within 16 bits, i.e., the process bit number of D/A converter 5, the tone waveform data to be added is allowed to consist of 13 bits at the most.

Output stage controller 28-2 provides a signal for rendering control signal line L13 of waveform bit switching circuit 28-9 active (i.e., "1") in synchronism to the channel time of the 1-st and 9-th channels which are the first channels of parts 1 and 2. Thus, in parts 1 and 2 waveforms consisting of 13 bits as effective bits are selected. This will be described later in detail.

Figure 16:
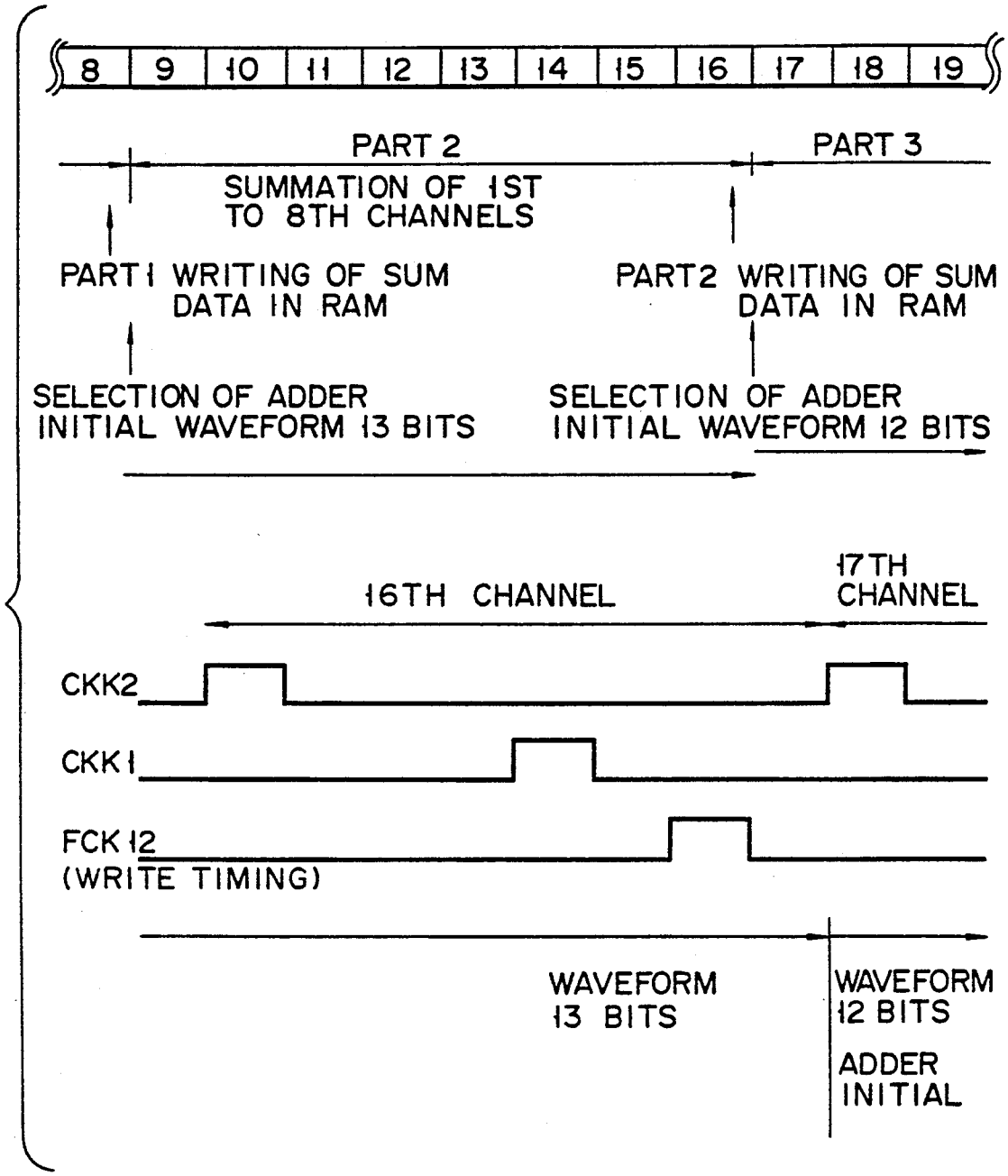
FIG. 16 is a time chart for explaining the operation of the output section.

In the channel time of the 1-st and 9-th channels, half-adder 28-15 is initialized according to signal from NOR gate 28-3, NAND gates 28-4 and inverters 28-5, so that addition is executed afresh on a time-division basis from the 1-st and 9-th channels. When the addition of data of the 8-th and 16-th channels is ended, the result of addition from the 1-st to the 8-th channels and from the 9-th to the 16-th channels is written in a given area of sum data accumulation RAM 28-8 according to signal from inverter 28-6 and NAND gate 28-7. A timing chart of this operation is shown in FIG. 16.

In subsequent part 3, tone waveform data of 16 channels from the 17-th to the 32-nd channels is added together. In order that the result of addition is held within 16 bits which constitute the process bit number of D/A converter 5, each tone waveform data of the 16 channels is allowed to consist of 12 bits at the most. Accordingly, output stage controller 28-2 provides a signal for rendering control signal line L12 of waveform bit switching circuit 28-9 active in synchronism to the channel time of the 17-th channel, i.e., the first channel of part 3, thus switching the effective bits to 12 bits. In addition, half-adder 28-15 is initialized in the channel time of the 17-th channel. The tone waveform data consisting of 12 effective bits from the 17-th to the 32-nd channels are thus added together, and the resultant sum is written in sum data storage RAM 28-5.

In the above way, the addition is performed in optimum effective bits for the number of channels consisting of each part.

The stored tone waveform data in sum data storage RAM 28-8 is provided for each part to four A/D converters 5 in a distributed fashion under control of output stage controller 28-2 for conversion to serial data to be provided through buffer 28-10.

Bit switching circuit 28-9 has four bit groups each formed by commonly connecting 4 bits of 14-bit tone waveform data lines from operation section 27 through tri-state inverters 28-11 in order to permit switching of four different effective bit lengths (i.e., 11 to 14 bits). More specifically, as shown in the figure, bit group 0 consists of 4 bits ~WE1 to ~WE3, bit group 1 consists of 4 bits ~WE1 to ~WE4, and likewise bit groups 2, 3, . . . , 10 each consist of 4 bits, the bits of each group being shifted by one bit with respect to the bits of the preceding group. Bit groups 11 to 13 respectively include two, three and four overlapped input bits ~WE13. The 14-bit tone waveform data is supplied as 2's complement data to bit switching circuit 28-9.

In order to make the effective bits to be 11, 12, 13 and 14 bits in the above arrangement, signals each for rendering only each of control signal lines L11 to L14 active are necessary. As such signals, output stage controller 28-2 provides signals "1110", "1101", "1011" and "0111". It is now assumed control signal line L14 is rendered active so that signal "0111" for making the effective bits to be 14 bits is provided from output stage controller 28-2. This output signal is inverted through NAND gates 28-13*a* to 28-13*d* into "1000" to be supplied to RS latches 28-14*a* to 28-14*d*. As a result, RS latches 28-14*a* to 28-14*d* provide respective outputs of "1", "0", "0" and "0" so that only control signal line L14 is rendered to be "1". In this case, in bit group 0 only tri-state inverter 28-11 corresponding to control signal line L14 is enabled, and signal of bit ~WE0 is supplied to half-adder 28-15. Likewise, in bit groups 1, 2, . . . , 13 only tri-state inverter 28-11 corresponding to control signal line L14 is enabled, so that bits ~WE1, ~WE2, . . . , ~WE13 are supplied to half-adder 28-15. Further, even in bit group 13 only tri-state inverter 28-11 corresponding to control signal line L14, but bit group 14 consists of sole bits ~WE1, so that for this group bit ~WE13 is provided as signal line bit group 12. In this way, all the 14 bits from bit ~WE0 to bit ~WE13 are provided as effective bit length.

When only control signal line L13 is rendered to be "1", bit ~WE1 is provided as signal from bit group 0. From bit groups 1, 2, . . . , 12 respective bits ~WE2, ~WE3, . . . , ~WE13 are provided as signal, and from bit group 13 bit ~WE13 is provided as signal. In this case, 13 bits from ~WE1 to ~WE13 are provided to constitute the effective bit length. Likewise, when only control signal lines L12 and L11 are rendered to be "1", 12 bits from ~WE2 to ~WE13 and 11 bits from —WE3 to ~WE13 are provided as respective effective bit lengths.

In the above embodiment, each channel time is divided into two, i.e., first and second, halves, the former being used as read time and the latter as write time. However, it is possible to divide the channel time into a greater number of divisions so that the first division may be used as read time and the other divisions as write times for writing tone source control data corresponding to a plurality of channels of memory means in corresponding areas in one channel time.

What is claimed is:

1. A polyphonic electronic musical instrument for simultaneously generating a plurality of tone signals through a time-division process on a plurality of channels, comprising;

first memory means for storing tone waveform data;

second memory means for storing waveform control data including access data for accessing said first memory means for each channel;

allotting means for successively allotting on a time-division basis a channel time for each of a plurality of channels as a process time of that channel;

dividing means for dividing each channel time allotting by said allotting means into a plurality of divisions; and read/write control means for functioning in at least one division of time provided by said dividing means for accessing said first memory means by reading out the waveform control data corresponding to the current channel time from said second memory means, and also for functioning in at least one of the remaining divisions of time for writing the waveform control data of a given channel designated at that time to be changed in an area of said second memory means corresponding to said given channel.

2. The polyphonic electronic musical instrument according to claim 1, wherein each channel time is divided into two halves.

3. A sound source circuit for permitting simultaneous generation of a plurality of tone signals through a time-division process on a plurality of channels, comprising:

first memory means for storing waveform data;

second memory means for storing waveform control data including access data for accessing said first memory means for each channel;

allotting means for successively allotting on a time-division basis a channel time for each of a plurality of channels as a process time of that channel;

dividing means for dividing each channel time allotted by said allotting means into a plurality of divisions; and read/write control means for functioning in at least one division of time provided by said dividing means for accessing said first memory means by reading out the waveform control data corresponding to the current channel time from said second memory means, and also for functioning in at least one of the remaining divisions of time for writing the waveform control data of a given channel designated at that time to be changed in an area of said second memory means corresponding to said given channel.

4. A polyphonic electronic musical instrument for generating a plurality of tone signals through a time-division process on a plurality of channels; comprising:

operation means for varying a frequency of a musical tone through an operation of said operation means;

first memory means for reading, writing and storing a sounding on/off signal for each of the channels;

second memory means for reading, writing and storing frequency data for each of the channels;

third memory means for storing the sounding on/off signal stored in said first memory means;

fourth memory means for storing the frequency data stored in said second memory means;

varying means for varying the frequency data stored in said second memory means corresponding to a channel which is allotted with a currently generated musical tone;

transfer means for transferring the sounding on/off signals in each of said channels stored in said first memory means to said third memory means, and for transferring the frequency data stored for each channel in said second memory means to said fourth memory means, when variation of the frequency data being varied is completed by said varying means and one cycle of all channels is completed;

tone generation means for generating musical tones according to the sounding on/off signal and the frequency data for each channel transferred to said third and fourth memory means, respectively;

means for functioning in a first half of each channel time for reading out from said first and second memory means the stored sounding on/off signal and frequency data for each channel, and for also functioning in a second half of each channel time for writing the sounding on/off signal and frequency data read out for each channel from said first and second memory means to said third and fourth memory means, respectively; and means for functioning in the first half of each channel time for reading out from said third and fourth memory means the stored sounding on/off signal and frequency data for each channel and for providing the read-out data to said tone generating means, and for also functioning in the second half of each channel time for writing sounding on/off and frequency data for each channel in said first and second memory means, respectively.

5. A polyphonic electronic musical instrument for simultaneously generating a plurality of tone signals through a time division process on a plurality of channels, comprising:

allotting means for successively allotting on a time-division basis a channel time for each of a plurality of channels as a process time of that channel;

dividing means for dividing each channel time allotted by said allotting means into a plurality of divisions;

a source of control data corresponding at least to current channel time; and control means for functioning in at least one division of time provided by said dividing means for operating on control data corresponding to current channel time, and for functioning in at least one of the remaining divisions of time for changing control data of a given channel designated at that time.

6. A sound source circuit for permitting simultaneous generation of a plurality of tone signals through a time division process on a plurality of channels, comprising:

allotting means for successively allotting on a time-division basis a channel time for each of a plurality of channels as a process time of that channel;

dividing means for dividing each channel time allotted by said allotting means into a plurality of divisions;

a source of control data corresponding at least to current channel time; and control means for functioning in at least one division of time provided by said dividing means for operating on control data corresponding to current channel time, and for functioning in at least one of the remaining divisions of time for changing control data of a given channel designated at that time.

* * * * *